US006742948B2

(12) United States Patent
Feiner

(10) Patent No.: US 6,742,948 B2
(45) Date of Patent: Jun. 1, 2004

(54) APPARATUS FOR FLATTENING A SUBSTRATE AND METHOD THEREOF

(75) Inventor: David Feiner, Ra'anana (IL)

(73) Assignee: Aprion Digital Ltd., Netanya (IL)

( * ) Notice: Subject to any disclaimer, the term of this patent is extended or adjusted under 35 U.S.C. 154(b) by 136 days.

(21) Appl. No.: 09/982,880

(22) Filed: Oct. 22, 2001

(65) Prior Publication Data

US 2003/0077101 A1 Apr. 24, 2003

(51) Int. Cl.[7] ..... B41J 13/10

(52) U.S. Cl. ..... 400/645; 400/601; 400/645.3; 400/645.4; 399/406; 26/98

(58) Field of Search ..... 400/645, 645.3, 400/645.4, 601, 633, 633.2, 616.1, 619; 399/409; 271/188; 26/98

(56) References Cited

U.S. PATENT DOCUMENTS 3,387,814 A * 6/1968 Fischer ..... 248/507
4,069,999 A * 1/1978 Rew ..... 248/507
4,158,905 A * 6/1979 O'Leary ..... 24/530
4,273,457 A * 6/1981 Noda ..... 400/705.1
5,042,121 A * 8/1991 Young, Jr. ..... 26/98
5,384,938 A * 1/1995 Frederick ..... 24/306
5,518,229 A * 5/1996 Tahara et al. ..... 271/180
5,577,444 A * 11/1996 Toyama ..... 101/379
5,927,702 A * 7/1999 Ishii et al. ..... 271/9.09
6,102,595 A * 8/2000 Satoh et al. ..... 400/579
6,305,857 B1 * 10/2001 Crowley et al. ..... 400/579

* cited by examiner

*Primary Examiner*—Andrew H. Hirshfeld
*Assistant Examiner*—Dave A. Ghatt
(74) *Attorney, Agent, or Firm*—Eitan, Pearl, Latzer & Cohen Zedek, LLP

(57) ABSTRACT

A method and apparatus for flattening a substrate against a surface of a platform is provided. The method comprising positioning guides within a platform so that opposite edges of a substrate placed on the platform do not come in contact with at least one print head in close proximity over the substrate.

8 Claims, 2 Drawing Sheets

APPARATUS FOR FLATTENING A SUBSTRATE AND METHOD THEREOF

BACKGROUND OF THE INVENTION

Industrial sheet-to-sheet printers are typically large format machines capable of printing on different substrates of variable sizes and thickness. These printers may be suitable for printing, for example, cardboard sheets, paperboard, box boards, corrugated boards, vinyl sheets, metal sheet and wooden sheets. In order to ensure the quality of printing, the print head moves in close proximity, typically one to two millimeters, to the printed substrates. Some substrates tend to bend upwards at the edges, thus encountering the print head during printing and damaging it. This problem is also related to a variety of other manufacturing processes where the distance between a substrate and a moving tool is required to be very small. Such processes may be related, for example, to spreading systems, gluing systems and spraying systems.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which.

Figure 1:
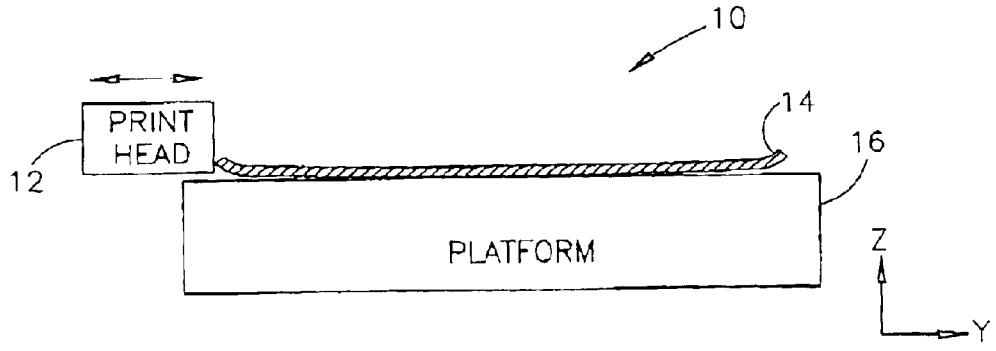
FIG. 1 is an illustration of the bending phenomenon helpful in understanding some embodiments of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Reference is now made to FIG. 1, which is an illustration of the bending phenomenon helpful in understanding some embodiments of the present invention. A printing machine 10 prints by moving at least one print head 12 along the Y-axis, while a substrate 14 mounted on a platform 16 moves along the X-axis. It should be noted that print head 12 may, however, move along either the Y-axis, the X-axis, or both, and may print bi-axially. As illustrated in FIG. 1, the edges of substrate 14 may bend upwards, losing contact with the surface of platform 16 so that print head 12 may touch the substrate's edges during printing thus causing damage to print head.

For clarity, the following description uses the example of a printing system. However, it will be appreciated by persons skilled in the art that embodiments of the invention are equally applicable to other systems having a movable tool in close proximity to a substrate mounted on a plane, such as, for example, a spraying system, a gluing system and the like.

Figure 2A:
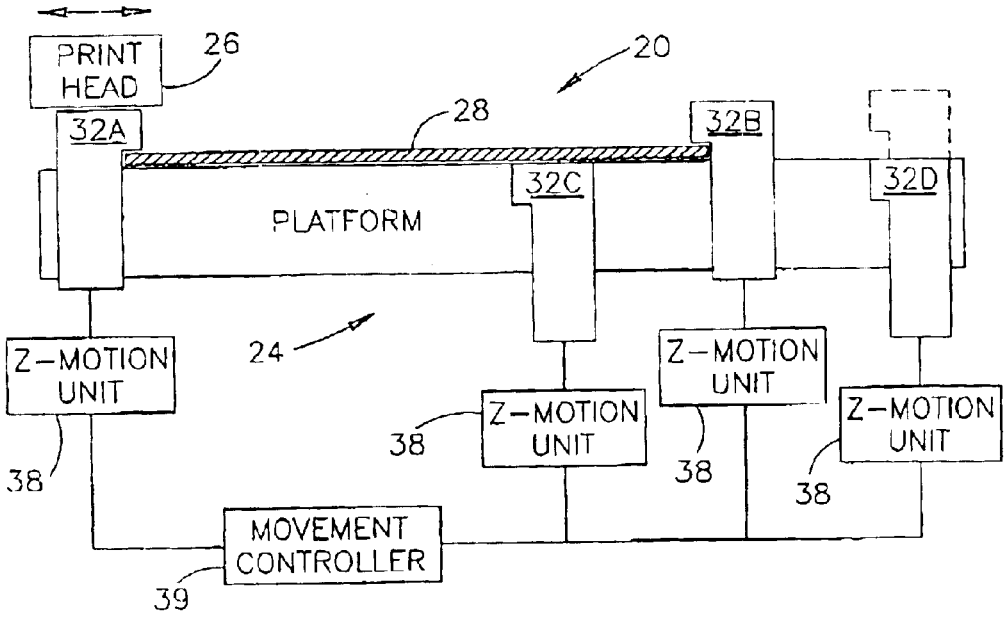
FIG. 2A is an illustration of a cross section of an apparatus for flattening a substrate, the apparatus constructed and operative according to some embodiments of the present invention.
Figure 2B:
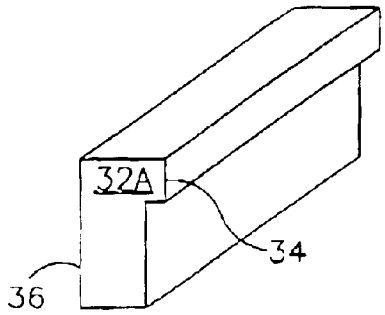
FIG. 2B is a perspective illustration of a guide constructed and operative according to some embodiments of the present invention.

Reference is now made to FIG. 2A, which illustrates a cross section of a printing system, generally designated 20, having an apparatus for flattening opposite edges of a substrate, the apparatus constructed and operative according to some embodiments of the present invention. Reference is additionally made to FIG. 2B, which is a perspective illustration of a guide constructed and operative according to some embodiments of the present invention.

System 20 may comprise a working platform 22, an apparatus 24 able to flatten opposite edges of a substrate and one or more print heads 26. A substrate 28 may be mounted on platform 22 and may be movable in the X direction.

Apparatus 24 may comprise two or more guides 32 positionable within platform 22. It should be noted that throughout the specification and the claims, the term "within the platform" refers also to being next to the platform on either side. Guides 32, which are elongated members having a generally L-shaped cross-section may be positioned generally parallel to the direction of movement of substrate 28. It should be noted that the cross-section of the guides may be curved and the term "L-shape" is not limited to a shape having defined perpendicular members.

At least one of guides 32 may be a left-sided guide, namely, it may be positioned to abut the left edge of substrate 28 and at least one of guides 32 may be a right-sided guide, namely, it may be positioned to abut the right edge of substrate 28.

Guide 32 may comprise a first portion 34, which is positioned generally parallel to the surface of platform 22 and a second portion 36, which is positioned generally perpendicular to the surface of platform 22 as shown in FIG. 2B.

Guides 32 may be movable in the Z direction, either manually or automatically and may be positioned at a low-position so that portion 34 is below or alternatively at the level of the surface of platform 22 and at a high-position so that portion 34 protrude above the surface of platform 22.

Guides 32 may be adjustable on the Y-axis according to the width of substrate 28 so as to enable smooth movement of print head 26 above substrate 28 by keeping the opposite edges of substrate 28 generally flat and in contact with platform 22.

During operation, as shown in the example of FIG. 2A, at least one left-sided guide 32A and at least one right-sided guide 32B may be selected so as to flatten the edges of substrate 28 and to enable substrate 28 to slip alongside the selected guides in the X direction. Left-sided guide 32A and right-sided guide 32B may be positioned at the high-position so that their respective portions 36 may each protrude above the surface of platform 22. Each portion 36 may abut a strip of the upper face of substrate 28 along all or part of one of the opposite edges of substrate 28. Each respective portion 38, which is generally perpendicular to the surface of substrate 28 may abut all or part of one of the opposite edges of substrate 28.

Other guides, which are situated between guides 32A and 32B, such as, for example, guide 32C, may be positioned at the low-position to enable the movement of substrate 28 during the printing. Other guides, such as, for example, guide 32D may be either in the high or low position.

According to some embodiments of the present invention, apparatus 20 may comprise at least one guide 32 movable in the Y-direction. The Y movement of guide 32 may enable positioning of guides 32 so as to vary the distance between a left-sided guide and a right-sided guide continuously.

Apparatus 24 may further comprise one or more z-motion units 38, each coupled to a respective guide 32. Z-motion unit 38 may be capable of moving guide 32 in a direction perpendicular to the surface of platform 28. Non-limiting examples of a z-motion unit may include a piston, a ball screw, an eccentric motion system, a belt, a hydraulic system, a pneumatic system and any other configuration capable of generating a vertical movement.

Apparatus 24 may further comprise a movement controller 39 coupled to z-motion units 34. Alternatively, controller 39 may be part of printing system 20. Movement controller 39 may be a processor able to receive digital information and to assign appropriate positions for guides 32 by instructing z-motion units 38.

Movement controller 39 may comprise a look-up table (not shown) comprising a list of user-defied substrate widths. Alternatively, movement controller may receive the dimensional information of substrate 28 from one or more digital input sensors (not shown) for sensing the X dimension of the substrate. The sensors may be any position-sensing devices known in the art, including a human eye.

Figure 3:
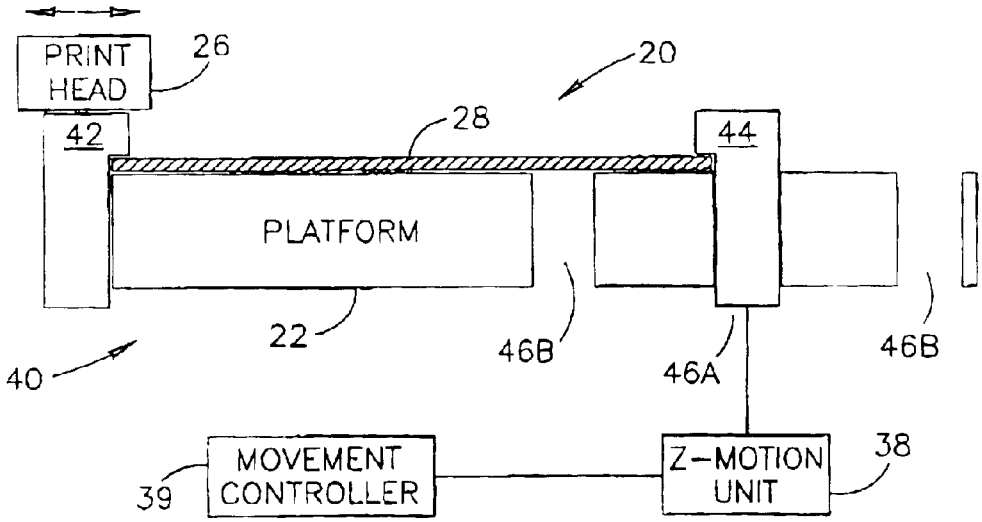
FIG. 3 is an illustration of a cross section of an apparatus for flattening a substrate, the apparatus constructed and operative according to other embodiments of the present invention.

Reference is now made to FIG. 3, which illustrate a printing system having an apparatus for flattening opposite edges of a substrate, generally designated 40, constructed and operative according to some embodiments of the present invention.

Apparatus 40 may comprise a left-sided guide 42 and a right-sided guided 44 positionable within platform 22, at least one of which is movable so that it may exit a first position 46A and may enter one or more positions 46B within platform 22 so as to adjust the distance between the guides. The width of substrate 28 may determine in which of the predetermined position the movable guide is situated.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. An apparatus for flattening a substrate against a surface of a platform, said apparatus comprising:

one or more left-sided guides positionable with respect to said platform, each having a generally flat, top left protrusion positioned generally parallel to said surface;

one or more right-sided guides positionable with respect to said platform, each having a generally flat, top right protrusion positioned generally parallel to said surface; and one or more z-motion units, each coupled to a respective one of said guides, able to move said guides in a direction perpendicular to said surface, wherein at least one of said guides is movable in a direction perpendicular to said surface so that its respective protrusion is positionable above, below or at said surface and when said substrate is on said platform one of said left-sided guides and one of said right-sided guides are positionable so that their respective protrusions lie above said substrate.

2. The apparatus of claim 1, wherein at least one of said guides is movable so as to vary a distance between said movable guide and another of said guides.

3. The apparatus of claim 1 further comprising a movement controller coupled to said z-motion units.

4. A printing system comprising:

at least one print head; and an apparatus for flattening a substrate against a surface of a platform, said apparatus comprising:

one or more left-sided guides positionable with respect to said table, each having a generally flat, top left protrusion positioned generally parallel to said surface;

one or more right-sided guides positionable with respect to said table, each having a generally flat, top right protrusion positioned generally parallel to said surface; and one or more z-motion units, each coupled to a respective one of said guides, able to move said guides in a direction perpendicular to said surface, wherein at least one of said guides is movable in a direction perpendicular to said surface so that its respective protrusion is positionable above, below or at said surface and when said substrate is on said platform one of said left-sided guides and one of said right guides are positionable so that their respective protrusions lie on said substrate so that said at least one print head is able to move in close proximity to said substrate without coming in contact with said substrate or said guides.

5. An apparatus for flattening a first edge and a second, opposite edge of a substrate having a lower face substantially in contact with a surface of a platform, the apparatus comprising:

one or more first guides positionable within said platform, each first guide having a first L-shaped cross-section such that if said first guide is positioned so as to protrude above said surface, a portion of said first guide generally parallel to said lower face abuts a strip of an upper face of said substrate along all or part of said first edge and a portion of said first guide generally perpendicular to said lower face abuts all or part of said first edge; and one or more second guides positionable within said platform, each second guide having a second L-shaped cross-section such that if said second guide is positioned so as to protrude above said surface, a portion of said second guide generally parallel to said lower face abuts a strip of an upper face of said substrate along all or part of said second edge and a portion of said second guide generally perpendicular to said lower face abuts all or part of said second edge, wherein a distance between said first edge and said second edge determines whether to position any of said guides so that they do not protrude above said surface and determines which one of said first guides and which one of said second guides are selected to abut said first edge and second edge respectively.

6. The apparatus of claim 5, wherein at least one of said guides is movable in a direction parallel to said surface and perpendicular to said first edge.

7. The apparatus of claim 5, further comprising one or more z-motion units, each coupled to a respective one of said guides, able to move said guides in a direction perpendicular to said surface.

8. An apparatus for flattening a first edge and a second, opposite edge of a substrate having a lower face substantially in contact with a surface of a platform, the apparatus comprising:

a first guide having a first L-shaped cross-section and positionable within said platform so that a portion of said first guide generally parallel to said lower face abuts a strip of an upper face of said substrate along all or part of said first edge and a portion of said first guide generally perpendicular to said lower face abuts all or part of said first edge;

two or more openings within said platform that are generally parallel to said first edge and said second edge; and a second guide having a second L-shaped cross-section and positionable within said platform so that a portion of said second guide generally parallel to said lower face abuts a strip of said upper face along all or part of said second edge and a portion of said second guide generally perpendicular to said lower face abuts all or part of said second edge, wherein a distance between said first edge and said second edge determines in which of said two or more grooves to position said second guide.

* * * * *